United States Patent [19]

Morris et al.

[11] 4,135,454

[45] Jan. 23, 1979

[54] SAFING A FLUERIC CARTRIDGE INITIATOR

[75] Inventors: Joseph W. Morris, Indian Head, Md.; Vincent P. Marchese, Morris Plains, N.J.

[73] Assignee: The United States of America as represented by the Secretary of the Navy, Washington, D.C.

[21] Appl. No.: 833,216

[22] Filed: Sep. 14, 1977

[51] Int. Cl.[2] ..... F42C 5/00

[52] U.S. Cl. ..... 102/205; 102/215; 102/224

[58] Field of Search ..... 102/205, 215, 224

[56] References Cited

U.S. PATENT DOCUMENTS

| | | | |
|---|---|---|---|
| 3,578,011 | 5/1971 | Holmes | 102/205 X |
| 3,672,300 | 6/1972 | Axelson et al. | 102/205 X |
| 3,866,535 | 2/1975 | Hedeen et al. | 102/224 |
| 3,985,058 | 10/1976 | Corrado et al. | 102/205 X |
| 4,033,267 | 7/1977 | Morris et al. | 102/205 |

OTHER PUBLICATIONS

"Proceedings of the 9th Symposium on Explosives and Pyrotechnic", The Franklin Inst. Research Laboratories, Sep. 15-16, 1976.

*Primary Examiner*—David H. Brown
*Attorney, Agent, or Firm*—R. Sciascia; R. Beers; Sol Sheinbein

[57] ABSTRACT

An improved flueric cartridge initiator (FCI) comprising a heat resistant or composite material resonance tube, a hardened high strength thermal disk and copper seals, in combination with an ignition train is made safe utilizing specific fluid dynamic phenomenon associated with the operation of the resonance tube. The present device uses simultaneous dual fluid inputs to create a Boolean AND logic element in order to reduce inadvertent firing functioning of the FCI.

12 Claims, 4 Drawing Figures

SAFING A FLUERIC CARTRIDGE INITIATOR

BACKGROUND OF THE INVENTION

The present invention is related to a cartridge actuated device and more particularly to the safing of a gas driven cartridge having no moving parts.

Increased aircraft performance envelopes and variable mission profiles have resulted in more complex aircrew automated escape systems (AAES). Because more stringent AAES performance requirements are needed to ensure safe crew-member recovery, additional maintenance and safety problems with potential consequent degradation of AAES performance and reliability have become apparent. In order to obtain AAES performance improvement, more accurate event sequencing and timing has been required. However, current AAES technology can provide pyrotechnic delay cartridges with an accuracy of only ±15% over the temperature range of −65° F. to 200° F. These pyrotechnic time delay cartridges provide nominal fixed time delays for the entire aircraft operational envelope, which are not optimum for all ejection conditions.

Because of the above mentioned current AAES problem areas and others, and the potential solution offered by fluidics, efforts to investigate the feasability of incorporating fluidic technology in AAES has resulted in the development of a Flueric Cartridge Initiator (FCI), disclosed in U.S. Pat. No. 4,033,267, issued July 5, 1977, to applicants herein. The FCI patent, incorporated herein by reference, discloses a fluidic device which operates on a gas flow phenomena where resonance takes place in a stepped cylindrical tube when a jet of gas is directed at it. This gas resonance generates extremely hot temperatures, e.g., on the order of 2000°, within a few milliseconds and can be used to ignite explosives, pyrotechnics or propellants in times as short as 3 milliseconds.

The FCI interfaces with a fluidic sequence (FS) which controls its actuation. The sequencer mode of operation provides one output from a cool/warm gas generator. A second input (the firing signal) occurs later, at a time specified by the sequencer depending on the ejection parameters. By itself, this requirement for the above referenced FCI to be compatible with the sequencer does not require the FCI to have AND logic built in. The same thing could be done with a simpler NOR logic configuration. For NOR logic, the first signal can be used to inhibit operation while the second signal comes on. The firing signal would then be the absence of the inhibiting signal. NOR logic, however, is inadequate to insure against inadvertent ignition if the FCI is accidentally connected to a gas supply. One input could not cause ignition but the other possibly could. Thus, to insure safety in the event that gas is inadvertently connected to either of the two inputs of the FCI, it must have an AND logic capability. However, the FCI of U.S. Pat. No. 4,033,267 does not disclose AND logic capability means for safing the device so that accidental ignition of the primary explosives, etc., is made extremely unlikely.

SUMMARY OF THE INVENTION

Accordingly, it is an object of the present invention to provide a means for safing a fluidic device used for initiating an explosive, pyrotechnic, or propellant charge.

Another object of the present invention is to provide a flueric cartridge initiator having built-in AND logic.

These and other objects of the invention are attained in a flueric device utilizing two inputs from a fluidic sequencer, one of which is on at all times, without firing or actuating the device. Only when the second input is actuated will the flueric device be initiated. In this manner, the flow and pressure required to be switched by the sequencer can be reduced to half of the total flow and the flueric device becomes much less prone to accidental initiation.

BRIEF DESCRIPTION OF THE DRAWINGS

A more complete understanding of the invention and a fuller appreciation of the many attendant advantages, features and still other objects thereof will be readily derived by reference to the following detailed description when considered in connection with the accompanying drawings, wherein:

Referring now to FIG. 1 there is shown the FCI of U.S. Pat. No. 4,033,267 in whch a housing 8 has a tube holder 10 removably mounted into an output charge holder 12. Although any high strength heat resistant material may be used in the manufacture of these major components steel is preferred and stainless steel 303 is most preferred.

Figure 1:
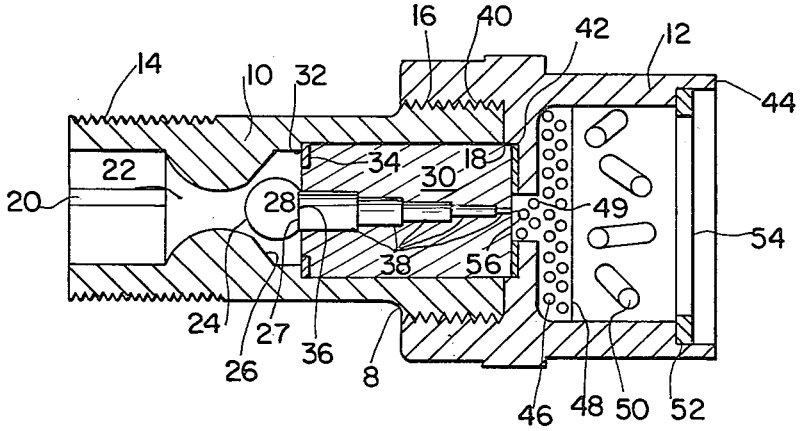
FIG. 1 PRIOR ART
FIG. 1 is a cross-sectional view of a flueric cartridge initiator (FCI).

The tube holder 10 is defined by an externally threaded aft end 14 and an externally threaded forward end 16 which is designed for mating to the aft end of the output charge holder 12. Leak proof mating of these two components is effected by incorporating a deformable lead-tight output washer 18 intermediate the output charge holder 12 and a resonance tube 30. Although it is preferred that the output washer 18 be made of copper, any deformable material which has similar heat and corrosion resistivity is adequate. Incorporated through the threaded aft end 14 and along the longitudinal axis of the tube holder 10 is a nozzle 20 comprising a convergent zone 22, a throat 24 a divergent zone 26 and a transverse vent 28, passing through the divergent nozzle zone or diffuser portion 26. Adjacent to the forward end of the nozzle's divergent zone 26 and acting as a sealing gasket and separator between the nozzle 20 and the resonance tube 30 is an input washer 32. As with the output washer 18, it is preferred that the input washer 32 be made of copper, although any deformable material with similar heat and corrosion resistivity is adequate.

The forward end 16 of the tube holder 10 is machined along its longitudinal axis so as to accept the input washer 32 and the resonance tube 30. Additionally, a step 34 is machined on the end of the resonance tube 30 so as to properly seat the tube 30 inside the input washer 32, and thereby maintain the desired separation distance between the nozzle 20 and the resonance tube 30. After seating the input washer 32, the resonance tube 30 is loaded into the tube holder 10 through the forward end 16 thereby forming a leak-tight seal between the forward end of divergent zone 26 and the stepped end 34 of the resonance tube 30.

The resonance tube 30 is machined or cast so as to comprise a resonance cavity inlet 27 and a plurality of axially oriented cylindrical resonance cavity segments 38. These segments 38 are arranged from aft to forward in order of decreasing diameter.

The output charge holder 12 is defined on its aft end by an internally threaded section 40 and output washer seat 42. The forward end 44 of the output charge holder is machined so as to accept pyrotechnic transfer charge 46, closure disk 48, granulated double base output charge 50, copper crimp washer 52 and sealing disc 54. Although any common ignition material 46 will adequately work as the transfer charge, those of lead styphanate, lead azide, cellulose nitrate and potassium dinitrobenzfuroxane (KDNBF) are preferred. KDNBF is most preferrable because it is safer to handle and it exhibits a slightly better response time. However, it is necessary to provide a means of protecting the KDNBF from being disrupted by the hot resonating gases. Therefore, a thin metal high strength protective disk 56 is incorporated into the system between the resonance tube and ignition mix.

Inasmuch as the above-described FCI is adequately described in the referenced patent a detailed discussion of the mode of operation of the device would seem superflous. Succinctly however, the FCI operates when the resonance tube inlet is placed in the compression region of a free jet emanating from the nozzle. As the flow passes through the nozzle, it accelerates to supersonic speed and then readjusts to subsonic speed by compression through a shock wave. The process creates a series of diamond-shaped cells of alternate supersonic and subsonic flow. These cell or conical shock waves (Mach diamonds) intersect the jet axis throughout the length of the jet.

Although there is continuous flow into and out of the resonance cavity, a portion of the gas remains trapped at the closed end and undergoes many cycles of periodic compression and rare faction. This periodic compression and expansion of the gas, within the rigid cavity of the resonance tube, produces irreversible temperature increases, which may be several times the initial adiabatic temperature head. The thermal energy generated by this process is concentrated at the closed end of the resonance tube and can be utilized to initiate exothermal processes requiring elevated temperature and/or heat flux as the initiation mechanism.

As was explained above, the subject FCI is not adequately safed to insure against inadvertent ignition if the FCI is accidently connected to a gas supply. In a use of the FCI certain safing requirements need to be met if the input of the FCI is connected to a gas supply. When the proper nozzle is installed and aligned properly, all that is needed is the correct gas, e.g., helium, and gas pressure. Therefore in interfacing the FCI with the fluidic sequencer (FS, mentioned above), the following design requirements for the FCI/FS interface have been developed:

1. The FCI must meet a 400 psi no-fire requirement from a safety standpoint.

2. The FCI must minimize subsystem pressure requirements in order to reduce power supply requirements and gas generator envelope.

3. Because of the pressure recovery capabilities of fluidic elements (on the order of 60%), the FS pressure output must be kept at a minimum.

In anaylzing the above design requirements, an AND element concept has been found to be satisfactory. An AND element, in Boolean logic terms, is an element that is only true when two inputs are true, i.e., the element only has an output when both inputs are present. Quantitatively the design parameters can be stated as such:

1. Best all fire performance with 200-to 250 psi supply to both inputs.

2. Best no fire performance with 400–500 psi helium supply to one input.

3. Best no fire performance with 400–500 psi air supply to one input.

It was felt that the concept of limiting the mass flow rate in the FCI was a valid approach. For example, if two orifices, each with a smaller cross-sectional area than the nozzle throat in the FCI were placed upstream of the nozzle throat, then these would choke and therefore control the mass flow rate to the throat, preventing resonance tube functioning. However, when the control orifices choke, the gas flow might accelerate to supersonic flow in the orifice assembly/nozzle connecting lines or chamber. The diffuser portion of the nozzle would then decelerate the flow to subsonic velocities and no resonance tube heating would occur, even with both inputs. If the orifice/nozzle throat distance is decreased, the danger of accelerating the gas flow is reduced.

Figure 2:
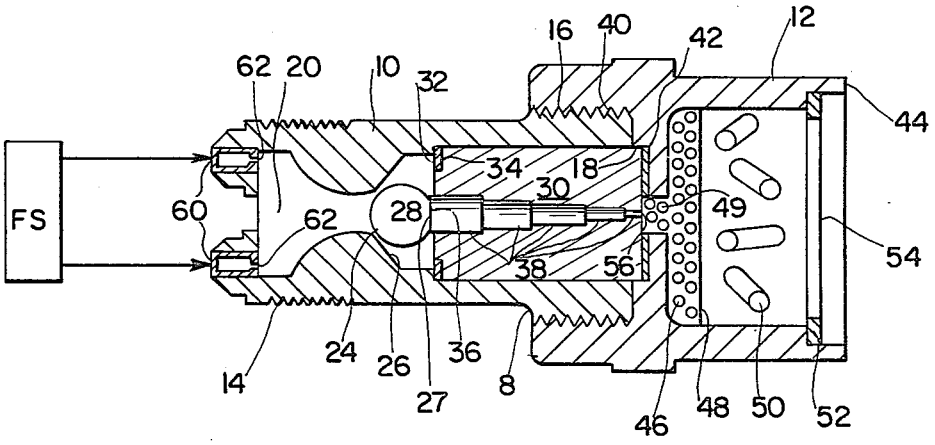
FIG. 2 is a cross-sectional view of a modified FCI having a orifice control AND element and thus has been safed in accordance with the present invention.

FIG. 2 shows a modified FCI which has been safed against inadvertent firing. As can be seen, two control orifice assemblies 60 have been added to the upstream portion of nozzle 20. Assemblies 60 receive a fluid, e.g., helium, at predetermined pressures from a fluidic sequencer FS, which comprises, in part, a cool/warm gas generator (not shown). The sequencer mode of operation provides one input to the FCI as soon as it is actuated and a second input (the firing signal) at a later time specified by the FS which takes into account the ejection parameters.

Figure 4:
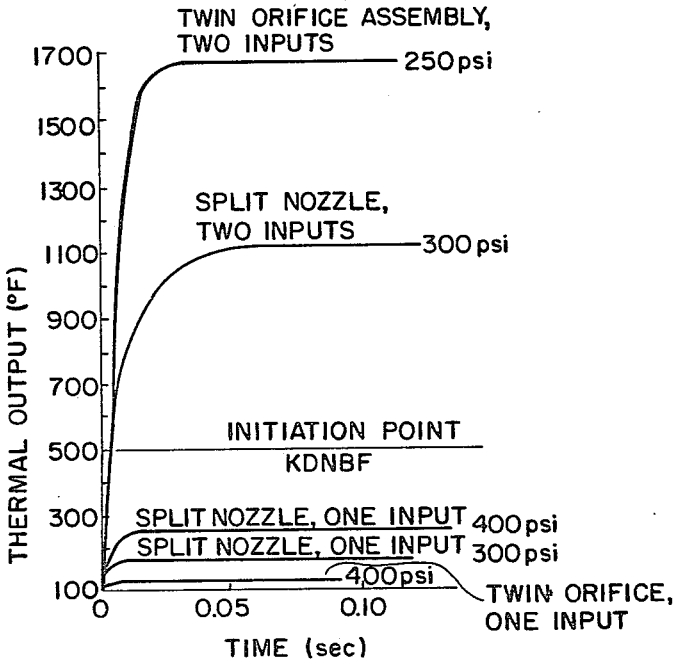
FIG. 4 shows the resonance tube thermal response time for orifice flow control and split nozzle AND elements.

Each assembly has an orifice or resister 62 which communicates with the nozzle 20. As shown in FIG. 4 if only one input from a fluid input line from the FS is activated, the restrictors 62 in the fluid input line prevent the nozzle 20 from obtaining sufficient flow to drive the resonance tube 30. With both inputs connected, the nozzle 20 can adequately drive the resonance tube 30 in order to obtain necessary ignition temperatures. This concept lends itself well to evaluation and verification by simply conducting tests with various nozzle and restrictor sizes. The goal is to have good response with both and no (or very little) thermal output with just one supply. The use of twin orifices to restrict the flow to the nozzle has been successfully applied as can be seen from FIG. 4.

Figure 3:
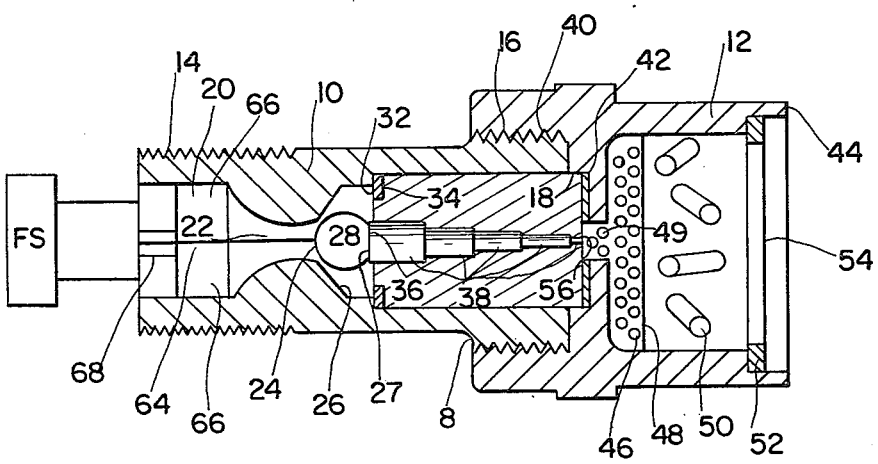
FIG. 3 shows a FCI utilizing a split nozzle AND element in accordance with the present invention.

An alternative and less preferred embodiment of the invention is depicted in FIG. 3. The split nozzle concept of this figure incorporates the above-mentioned principles of limiting the mass flow rate through the nozzle 20 in order to provide a safed flueric device. It is noted that in using the twin-orifice concept, the gas flow might accelerate to supersonic flow in the nozzle volume or chamber between the orifices and the nozzle throat. The diffuser portion of the nozzle would then decelerate the flow to subsonic velocities and no resonance tube heating would occur, even with both inputs. If the orifice/nozzle throat distance is decreased the danger of accelerating the gas flow is reduced. The limit would be placing the orifices in the nozzle throat itself. Thus rose the concept of a split nozzle.

The split nozzle concept involves utilizing a metal splitter 64 in the nozzle throat 24 to control mass flow rate. Because the orifices 62 and splitter 64 act as resistances, the AND element functions in parallel, i.e., each orifice 62/splitter side 66 requires the FCI operating pressure, i.e., 400 psi. Therefore, there is no reduction in FCI power supply requirements, but the 400 psi no-fire/safety requirement is met. Thus, the ANDing element with orifice/splitter has been pursued due to the safety aspect.

The splitter plate 64 can be fixed within the nozzle by a transverse support 68 which allows the splitter plate to extend proximate the upstream side of nozzle 20 a point contiguous to the throat 24. The splitter plate should not extend downstream of the throat inasmuch as it would otherwise interfer with the formulation of the shock waves needed within resonance tube 30.

In operation, if there is flow in either side of the split nozzle, then the mass flow rates will not be sufficient to power the resonance tube. Only when both sides have power would there be a sufficient mass flow rate.

A split nozzle can be accomplished by machining a standard nozzle along its centerline, sandwiching a 302 stainless steel splitter between the halves and epoxying the assembly. In tests, a 1-mil and 2-mil thick splitter functioned properly when both inputs were present, but the splitter distorted mechanically due to the pressure differential when only one input was activated. Once the distortion occurred, the FCI thermal output increased. Also the epoxy did not provide a sufficient bond and leakage occurred. A 0.01" splitter proved to be too thick, since thermal outputs with both inputs was degraded significantly. By assembling the split nozzle with a pair of 2–56 screws and using a 0.004" 302 stainless steel (full hard) splitter, significant improvements on resonance tube AND element output were achieved, see FIG. 4. The splitter did not distort but produced somewhat lower output with two inputs than a standard 0.38 caliber FCI, see U.S. Pat. No. 4,033,267.

The use of the twin orifice assembly to restrict the flow has been successfully evaluated. The preliminary test results, see FIG. 4, indicates that the twin orifice method produces a higher output with two inputs and a lower output with only one input than the split nozzle and must therefore be considered the preferred embodiment. It is noted that in all cases with both the twin orifice method and the split nozzle concept the initiation point of the material to be ignited, e.g., KDNBF (see U.S. Pat. No. 4,033,267), was not reached when only one input was present.

Thus, what had been described is a flueric device used for initiating an explosive, etc., which is made safe by a Boolean AND element.

It is to be understood that what has been described is merely illustrative of the principles of the invention and that numerous arrangements in accordance with this invention may be devised by one skilled in the art without departing from the spirit and scope thereof.

What is new and desired to be secured by Letters Patent of the United States is:

1. In combination with a flueric cartridge initiator of the type wherein a housing being defined by aft and forward ends, includes a convergent-divergent nozzle axially incorporated through said aft end, a transverse vent passing through the divergent zone of said nozzle and axially oriented with said nozzle, a resonance tube having a plurality of resonance cavities aligned in decreasing size order along the longitudinal axis of said resonance tube, and wherein a pyrotechnic transfer charge in juxtaposition with said resonance tube is ignited by thermal energy generated as a gas introduced into said flueric cartridge initiator through said nozzle undergoes periodic compression and expansion within said resonance cavities, the improvement which comprises:

a Boolean AND logic element located within said nozzle whereby said initiator is safed against inadvertent ignition of said transfer charge.

2. The combination of claim 1 wherein said element comprises two orifices placed upstream of the throat of said nozzle; and fluid means for supplying one fluid input to each of said orifices in a predetermined sequence.

3. The combination of claim 2 wherein each orifice has a smaller cross-sectional area than the nozzle throat; whereby if only one input is supplied, the orifice in fluid communication with said input prevents said nozzle from obtaining sufficient flow but with both inputs supplied said nozzle can adequately drive said resonance tube in order to obtain necessary ignition of said transfer charge.

4. The combination of claim 1 wherein said element comprises a splitter plate fixed within said nozzle, whereby splitter sides are formed within said nozzle.

5. The combination of claim 4 wherein the splitter plate does not physically extend downstream of said throat.

6. The combination of claim 5 wherein each splitter side communicates with a means for supplying each splitter side with an input of fluid pressure whereby if only one input is supplied, the splitter side in fluid communication with said input prevents said nozzle from obtaining sufficient flow but with both inputs supplied said nozzle can adequately drive said resonance tube in order to obtain necessary ignition temperatures of said transfer charge.

7. In combination with a flueric cartridge initiator of the type wherein a housing being defined by aft and forward ends, includes a convergent-divergent nozzle axially incorporated through said aft end, a transverse vent passing through the divergent zone of said nozzle and axially oriented with said nozzle, a resonance tube having a plurality of resonance cavities aligned in decreasing size order along the longitudinal axis of said resonance tube, and wherein a pyrotechnic transfer charge in juxtaposition with said resonance tube is ignited by thermal energy generated as a gas introduced into said flueric cartridge initiator through said nozzle undergoes periodic compression and expansion within said resonance cavities;

means for sealing said flueric cartridge initiator so as to prevent gas blowback, wherein said means includes:

said convergent-divergent nozzle which forms a tube holder having an externally threaded forward end, said forward end being machined along its longitudinal axis so as to accept a deformable input washer;

said resonance tube, inserted into said tube holder so as to form a leak-tight seal with said input washer when said flueric cartridge initiator is fully loaded, an output charge holder having an internally threaded aft end for mating with forward end of said tube holder;

a deformable output washer, for creating a leak-tight seal between the forward end of said resonance tube and said output charge holder; and a high strength thermal disk for preventing gas blowback from said transfer charge, the improvement which comprises:

a Boolean AND logic element located within said nozzle whereby said initiator is safed against inadvertent ignition of said transfer charge.

8. The combination of claim 7 wherein said element comprises two orifices placed upstream of the throat of said nozzle; fluid means for supplying one fluid input to each of said orifices in a predetermined sequence.

9. The combination of claim 8 wherein each orifice has a smaller cross-sectional area than the nozzle throat; whereby if only one input is supplied, the orifice in fluid communication with said input prevents said nozzle from obtaining sufficient flow but with both inputs supplied said nozzle can adequately drive said resonance tube in order to obtain necessary ignition temperatures of said transfer charge.

10. The combination of claim 7 wherein said element comprises a splitter plate fixed within said nozzle, whereby splitter sides are formed within said nozzle.

11. The combination of claim 10 wherein the splitter plate does not physically extent downstream of said throat.

12. The combination of claim 11 wherein each splitter side communicates with means for supplying each splitter side with an input of fluid pressure, whereby if only one input is supplied, the splitter side in fluid communication with said input prevents said nozzle from obtaining sufficient flow but with both inputs supplied said nozzle can adequately drive said resonance tube in order to obtain necessary ignition temperatures.

* * * * *